United States Patent [19]

Sachs

[11] 4,056,074

[45] Nov. 1, 1977

[54] HYDROFOIL KIT

[76] Inventor: Elmer B. Sachs, 3371 Rexford, Ventura, Calif. 93003

[21] Appl. No.: 679,772

[22] Filed: Apr. 23, 1976

[51] Int. Cl.[2] ..... B63B 1/26

[52] U.S. Cl. ..... 114/280

[58] Field of Search ..... 114/66.5 R, 66.5 H, 114/66.5 P, 123, 126, 274, 278, 280, 282, 283; 115/17, 70, 18 R, 41 R

[56] References Cited

U.S. PATENT DOCUMENTS

| | | | |
|---|---|---|---|
| 1,006,118 | 10/1911 | Napier | 114/66.5 H |
| 1,184,207 | 5/1916 | Perrault | 114/126 |
| 2,584,347 | 2/1952 | Hazard | 114/280 |
| 2,747,819 | 5/1956 | Aldrich et al. | 115/41 R |
| 2,991,747 | 7/1961 | Bader et al. | 114/66.5 H |
| 3,199,484 | 8/1965 | Wiberg | 114/66.5 H |
| 3,241,511 | 3/1966 | Drtina | 114/66.5 H |
| 3,980,035 | 9/1976 | Johansson | 115/17 |

FOREIGN PATENT DOCUMENTS

| | | | |
|---|---|---|---|
| 147,473 | 10/1954 | Sweden | 114/66.5 H |

*Primary Examiner*—Trygve M. Blix
*Assistant Examiner*—Jesus D. Sotelo
*Attorney, Agent, or Firm*—Jack C. Munro

[57] ABSTRACT

A kit containing a plurality of hydrofoil assemblies which can be easily and quickly attached to a conventional boat hull thereby causing the boat to operate with the hull of the boat spaced above the surface of the water. There are three separate hydrofoil assemblies, with one being located at the stern of the boat in conjunction with the outboard motor. The other hydrofoil assemblies are located approximately amidship with one on the starboard side and the other on the port side. The midship hydrofoil assemblies are interconnected together through a flexible band which functions to securely attach these hydrofoil assemblies to the boat hull. Each of the hydrofoil assemblies are adjustable with respect to the hull of the boat. In a larger boat, there may be four (in number) or more of the hydrofoil assemblies attached to the boat hull.

3 Claims, 16 Drawing Figures

HYDROFOIL KIT

BACKGROUND OF THE INVENTION

The field of this invention relates to boating, and more particular to the minimizing of the drag of the boat with the water as the boat is operated.

It is well known that the hull of a boat imposes quite a large drag as it is moved through the water. The reason for this is that there is substantial surface area in contact with the water and the greater the surface area, the greater the drag. In the past, there have been substantial efforts at designing hulls having a minimum amount of drag.

Besides designing of low drag type of hulls, there is also the concept of employing hydrofoils. As the boat is operated at a reasonably fast speed, the foils which are located in a spaced distance below the hull of the boat, incur lift to the point that the hull of the craft is supported and rises and travels clear of the water. At low speeds, the hydrofoil craft operates on the conventional displacement hull. By using the hydrofoils, the drag against the hull is eliminated and the only drag is against the hydrofoil units. This means that a less powerful motor can be employed to operate the boat at a fast rate of speed.

There have been a substantial number of hydrofoil type boats built. But these boats are generally of relatively large size, thirty feet or longer. Although a smaller hull, such as a sixteen foot hull hydrofoil boat could be built, in the past there has been very little effort toward the designing of such a boat.

To even go a step further, there is a significant number of small boats in use and if there was some way to design structure which could be attached to the small hull boat and thereby make the small hull type of boat, a hydrofil type boat, such a structure would be of significant value. Such small boats usually employ an outboard motor and a ten or fifteen horsepower motor could operate a hydrofoil type of boat at a speed twice as great as a conventional displacement hull type of boat.

SUMMARY OF THE INVENTION

This invention relates to the employing of a plurality of separate hydrofoil units which can be secured to a conventional displacement hull and thereby transform the conventional displacement hull type of boat into a hydrofoil type of boat. Each of the hydrofoil units can be adjusted with respect to the hull of the boat so that the distance of the hull above the water level can be varied and also the adjustment permits varying of the inclination of the boat. There are three separate hydrofoil assemblies employed, with one being connected to the outboard motor assembly in the stern of the boat and the other two being located slightly forward in midship and on opposite sides of the boat. The hydrofoil assemblies located approximately amidship are interconnected together through a flexible band which extends across the underside of the hull of the boat. Each hydrofoil assembly attached to the gunwale section of the boat. The flexible band can be tightened through a winch assembly so as to firmly lock into position the hydrofoil assemblies.

BRIEF DESCRIPTION OF THE SHOWN EMBODIMENTS

Figure 1:
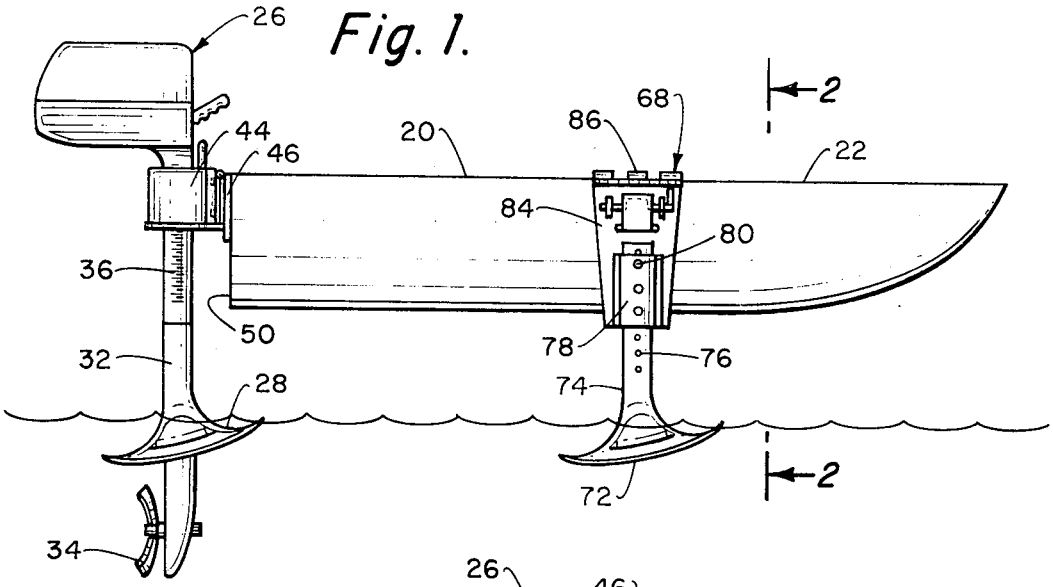
FIG. 1 is a side view of a hull of a boat upon which has been secured the hydrofoil kit of this invention.
Figure 2:
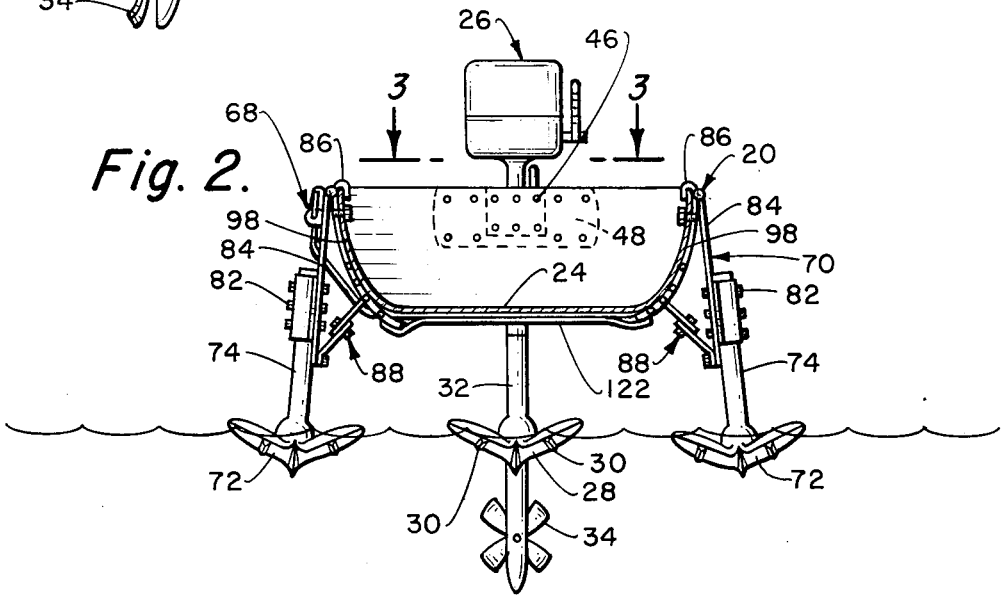
FIG. 2 is a front partly in section view taken along line 2—2 of FIG. 1.
Figure 3:
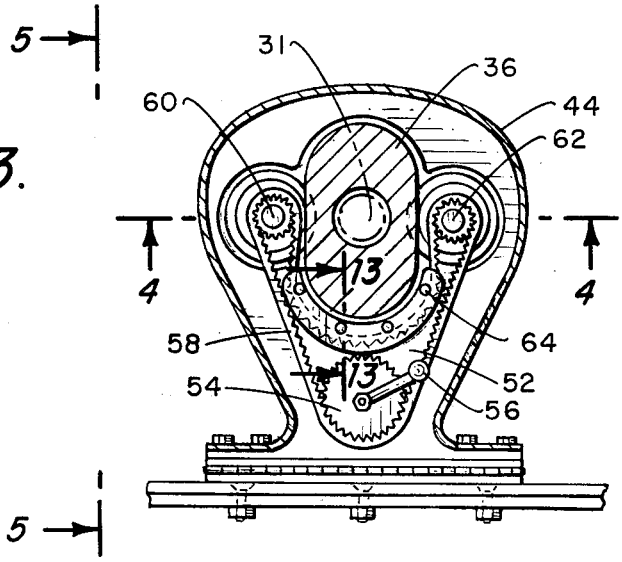
FIG. 3 is a top cross-sectional view taken along line 3—3 of FIG. 2 showing the structure required to raise and lower the stern hydrofoil unit.
Figure 4:
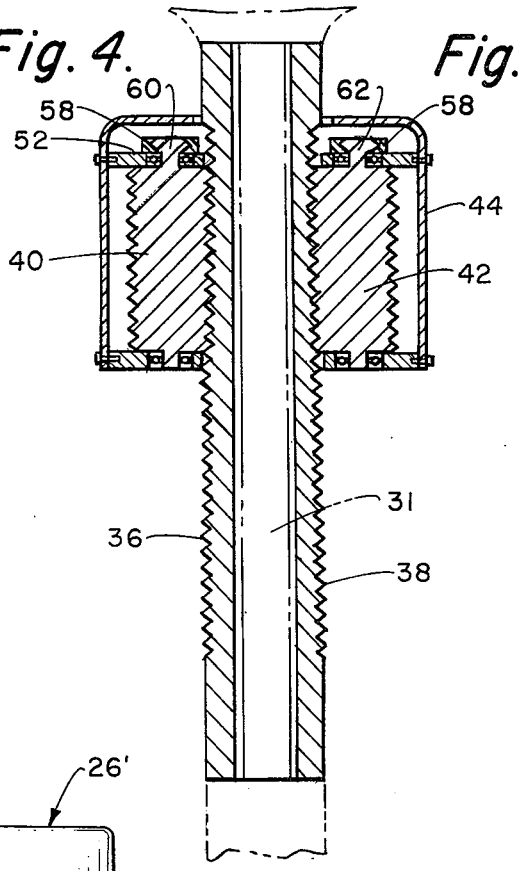
FIG. 4 is a cross-sectional view taken along line 4—4 of FIG. 3.
Figure 5:
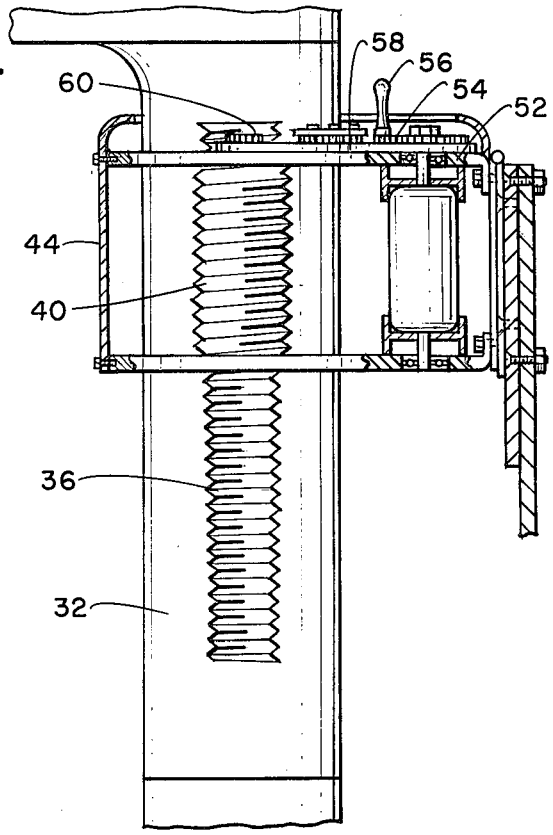
FIG. 5 is a side view taken along line 5—5 of FIG. 3.

Referring particularly to the drawings, there is shown in FIG. 1 a conventional boat hull 20 which has a gunwale section 22 and an interior chamber 24. Attached to the stern of the boat hull 20 is an outboard motor assembly 26. The outboard motor assembly is deemed to be essentially conventional in the form of its motor operation, but in this particular instance the motor assembly 26 has been modified to include a hydrofoil unit which includes a hydrofoil member 28. The hydrofoil member 28, as well as other hydrofoil members which will be described further on in the specification, are constructed in a particular manner so as to basically incur lift as the unit 28 moves through the water. The hydrofoil member 28 in cross section has a somewhat of a V-shape. The lower surface of the member 28 will be basically flat but does have a slight curve to it in the lengthwise direction. Also, the lower surface 28 includes some ribs 30 on each side of the center of the member 28. The ribs 30 function to help eliminate a side wash of the water across the lower surface of the member and helps to keep the water moving in a direction from the forward portion of the member to the aft portion of the member. The upper surface of the member 28 is slightly raised. The device 28 is designed to be canted at a slight angle as it is moved through water, such as shown in FIG. 1. When the device is used through water, there will be a lift created, a significant lift, which when coupled with the other hydrofoil members to be described further on in the specification will function to lift the hull 20 of the boat completely out of the water.

Member 28 is shown in FIG. 1 to be integrally attached to the drive shaft housing 32 of the outboard motor assembly 26. The drive shaft 31 extends through the drive shaft housing 32 and connects with prop 34.

Formed on each side of the drive shaft housing 32 are a plurality of lengths of threads 36 and 38. A basically cylindrical shaped drive screw 40 connects with threads 36 with a similar such drive screw 42 connecting with threads 38. The drive screws 40 and 42 are rotatably supported within a structure which is secured to a housing 44. The housing 44 is, in turn, fixed to an attaching plate 46 which, in turn, is fixed to a mounting plate 48. The mounting plate 48 is fixedly secured to the stern 50 of the boat hull 20.

Rotatably mounted upon a plate 52 which is fixedly secured within the housing 44 is a winch wheel 54. A handle 56 is attached to the winch wheel 54 to facilitate manual rotation thereof. The winch wheel 56 is connected to a drive belt 58. The drive belt 58 is connected to gears 60 and 62. Gear 60 is fixedly attached to the member 40 with gear 62 being attached to member 42. The belt 58 passes over a plurality of low frictional rollers 64 which are rotatably mounted by means of pins 66 to the plate 52.

By rotation of the winch wheel 54, the drive belt 58 causes the gears 60 and 62 to rotate which, in turn, rotate members 40 and 42. The rotation of the members 40 and 42 upon their respective series of threads 36 and 38 causes the shaft housing 44, as well as the entire outboard motor assembly 26, to move vertically with respect to the hull 20. This vertical adjustment is desirable so as to adjust the inclination of the boat hull 20 as the boat is moving through the water or above the water.

Connected to the hull 20 just forward of midship is starboard side hydrofoil assembly 68 and port side hydrofoil assembly 70. Both the assemblies 68 and 70 are basically identical in configuration and therefore like numerals will be employed to refer to like parts.

The assemblies 68 and 70 each include a hydrofoil member 72. The hydrofoil member 72 is basically identical to member 28 and reference is to be had to the previous description for the details of the construction of the members 72. Each member 72 is attached to a post 74. Each post 74 includes a plurality of spaced apart openings 76. The posts 74 connect with a receiving plate 78. The receiving plate 78 includes a plurality of spaced apart openings 80. Within each of the openings 80 is located a bolt 82. These bolts 82 pass through one of the openings 76 in the post 74. The bolts 82 function to lock the post 74 to plate 84. Connected to the upper end of plate 84 is a U-shaped hook assembly 86. The hook assembly 86 extends over the gunwale section 22 of the boat. The lower end of the plate 84 is connected to a brace 88. The brace assembly 88 takes the form of a first plate 90 and a second plate 92 which are interconnected by a bolt 94. Bolt 94 can occupy one of several pair of aligned openings formed in each of the plates 90 and 92. This provides a lateral adjustment of each of the hydrofoil members 72 with respect to the boat hull 20. The pivoting outward of the plate 84 is permitted due to its pin connection by pin 96 with band plate 98.

The band plate 98 includes a plurality of pivot pins 100, 102 and 104 forming the band plate into a plurality of segments, an upper segment 106, a lower segment 108 and two middle segments 110 and 112. The plate 98 is to be located adjacent the side of the hull 20 and it is desirable to have the plate 98 closely conform to the hull. Since the hull is normally arcuate and also for different boats the curve would be different, the breaking up of the plate 98 into the plurality segment permits each segment to pivot with respect to each other and closely conform to the side of the hull 20.

Within the segment 112, there is located a pivot pin connection 114 with a similar such connection 116 being located within segment 110. An appropriate mating type of connection is located at the upper end of the plate 90 and by use of a pin 118 the brace 88 can be either connected to connection 114 or 116.

Within the segment 108, there is located an opening 120. A strap 122 is connected with the opening 120. The strap 122 may be formed of a strong material, such as a combination of plastic and fiber. One end of the strap 122 is attached to the plate 98 located on the starboard side of the hull with the other end of the strap 122 being conducted through a similar opening 120 located in the plate 98 on the port side of the hull. The strap is then continued to be doubled over upon itself adjacent the underside of the hull 20 and is conducted back through the opening 122 to which it is attached and then the free end of the strap 122 is wound around a rod 124. The rod 124 is rotatably mounted at each end by guide plates 126 and 128. The guide plates 126 and 128 are fixedly mounted upon winch plate 130. The winch plate 130 is fixedly secured to the plate 84.

Figure 16:
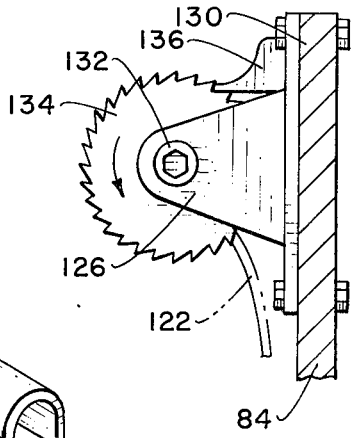
FIG. 16 is a side view of the winch section of the winch taken along line 16—16 of FIG. 15.
Figure 12:
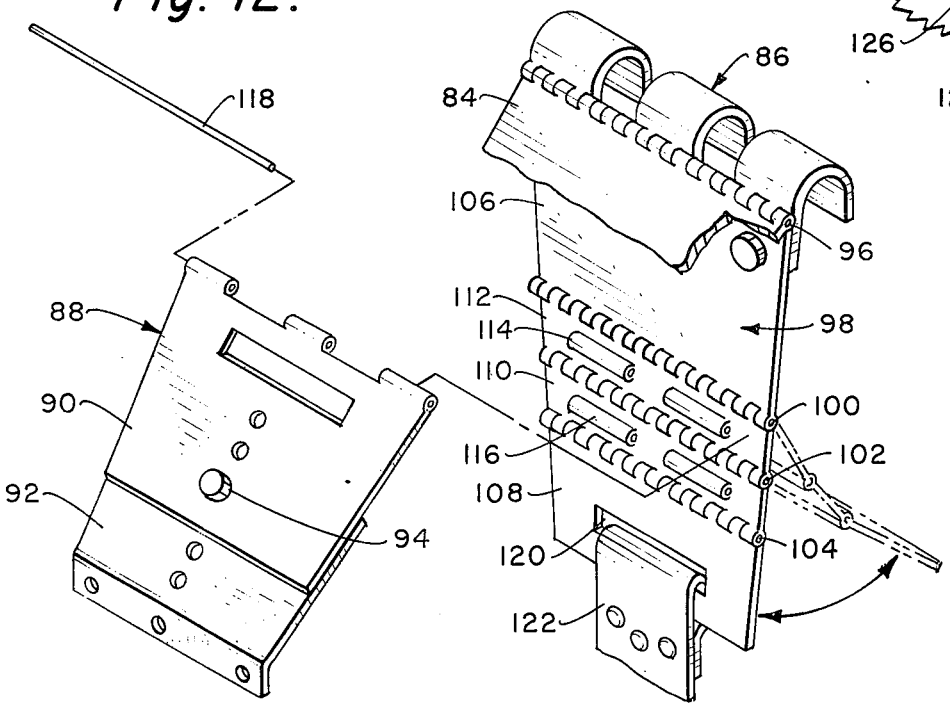
FIG. 12 is an exploded isometric view of the band structure innerconnecting the port side hydrofoil unit to the starboard side hydrofoil units.

One end of the rod 124 is formed into a polygonal shape 132 which is adapted to receive an appropriate tool (not shown). The tool is to function to rotate the rod 124. The rod 124 is also secured to rachet wheel 134. The ratchet wheel 134 connects with a locking pawl 136. The locking pawl 136 is pivotally mounted upon the plate 130. The locking pawl 136 normally permits only counterclockwise rotational movement of the wheel 134 (as shown in FIG. 16).

By rotating of the rod 124, the strap 122 is tightly stretched thereby tightly securing together about the hull 20 of the boat the hydrofoil assemblies 68 and 70.

When it is desired to remove the assemblies 68 and 70, it is only necessary to deflect upwardly the latch 136 which releases the wheel 134 permitting the strap 122 to be unwound from the rod 124.

Figure 6:
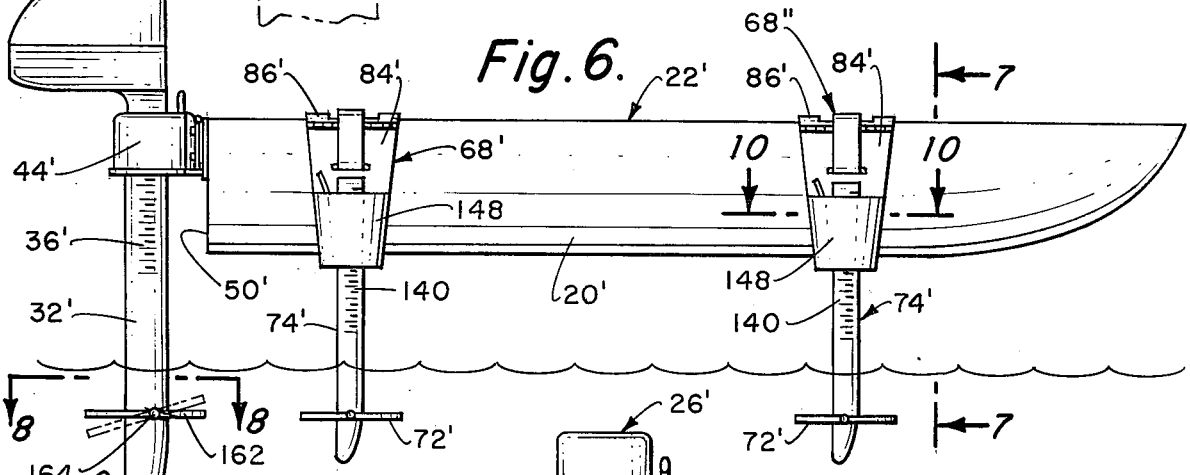
FIG. 6 is a view similar to FIG. 1 but of a modified form of hydrofoil kit structure of this invention.
Figure 7:
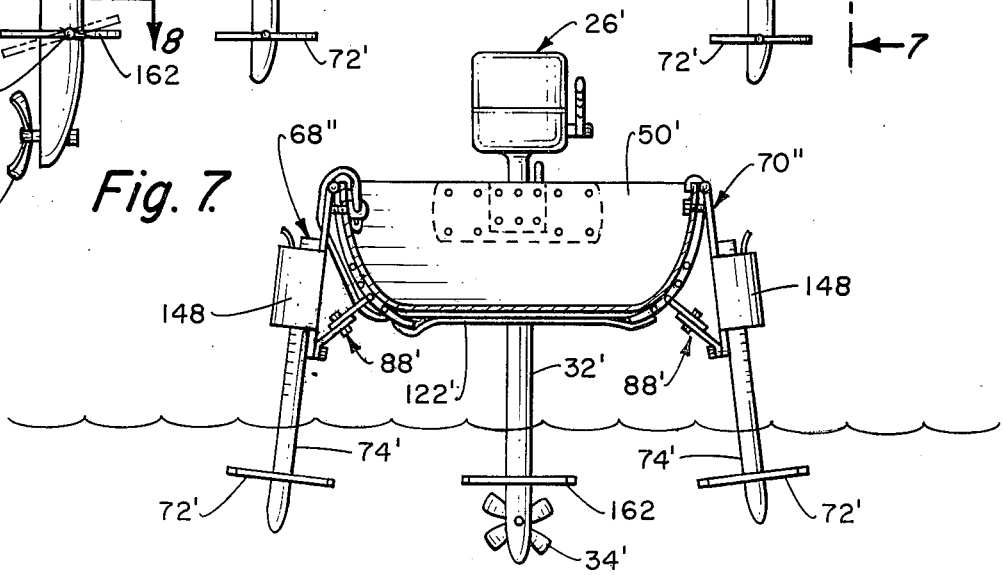
FIG. 7 is a front partly-in-cross-sectional view taken along line 7—7 of FIG. 6.
Figure 15:
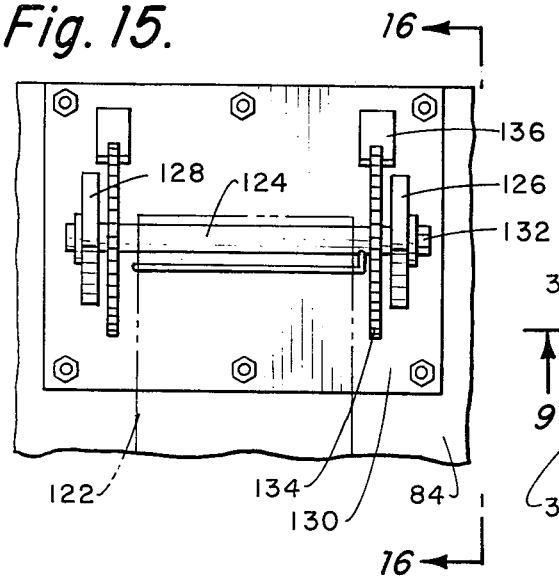
FIG. 15 is an enlarged view of the winch section showing lift detail in FIG. 1 which connects with the band shown in FIG. 12.
Figure 8:
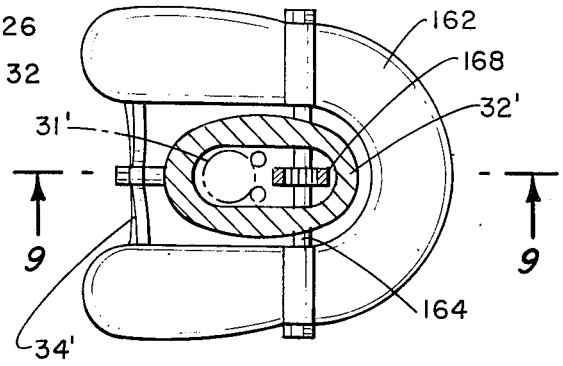
FIG. 8 is a cross-sectional view through the outboard motor assembly taken along line 8—8 of FIG. 6.
Figure 9:
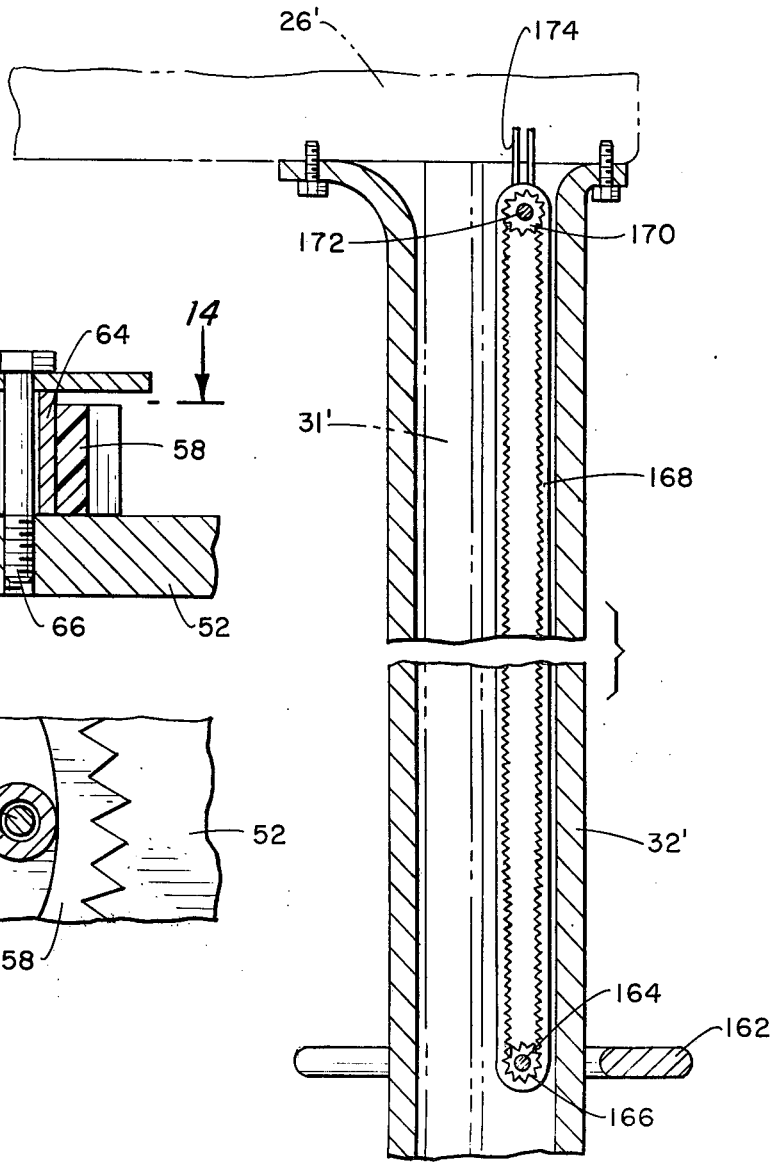
FIG. 9 is a cross-sectional view taken along line 9—9 of FIG. 8.
Figure 13:
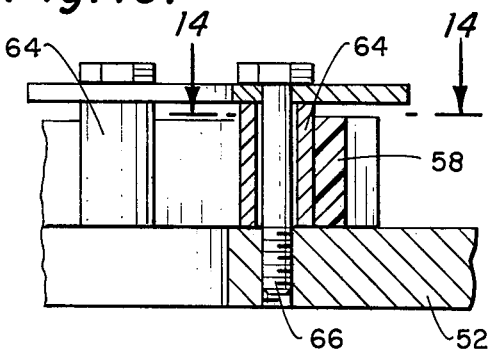
FIG. 13 is a cross-sectional view taken along line 13—13 of FIG. 3.
Figure 14:
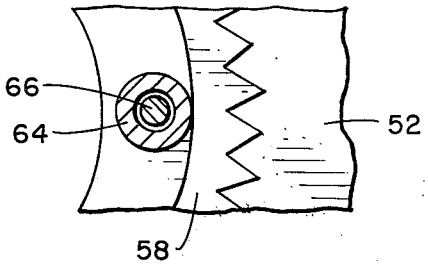
FIG. 14 is a cross-sectional view taken along line 14—14 of FIG. 13.
Figure 10:
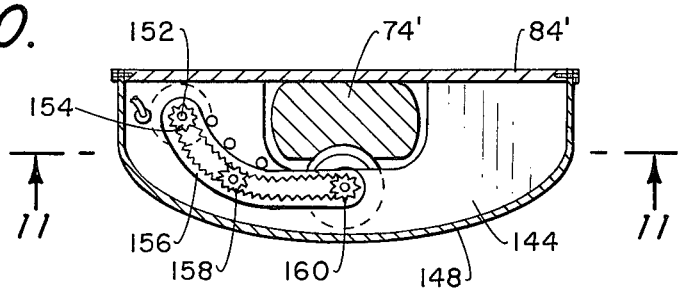
FIG. 10 is a cross-sectional view through the structure to raise and lower the forward hydrofoil units of this invention taken along line 10-10 of FIG. 6.
Figure 11:
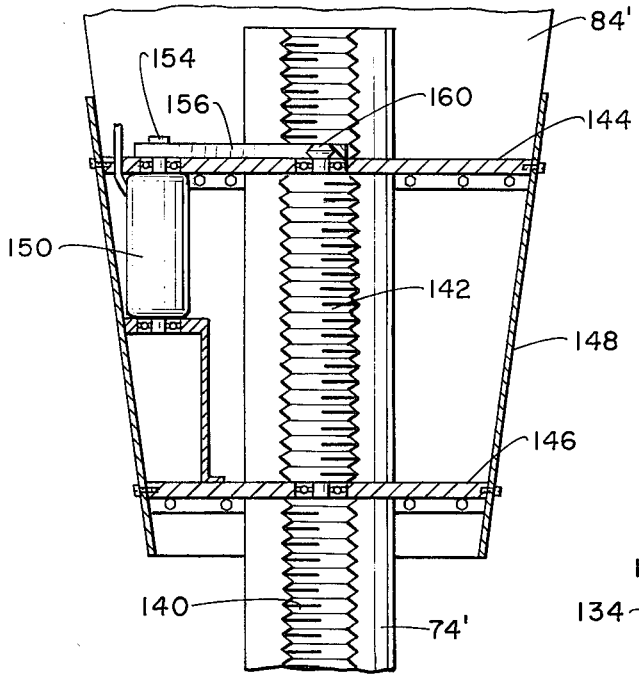
FIG. 11 is a cross-sectional view taken along line 11—11 of FIG. 10.

Referring particularly to FIGS. 6 and 7, there is shown a modified form of the structure of this invention. Like numerals have been employed to refer to like parts and reference is to be had to the foregoing description for the parts. The description of FIGS. 6 and 7 will be directed only to the differences in structures.

The first difference noted in FIGS. 6 and 7 is that the boat hull 20' is of a longer length. For such a larger boat, it may be desirable to employ more than three separate hydrofoil units and actually five separate hydrofoil units have been employed, with there being two on the starboard side and two on the port side. Each of the hydrofoil units 72' are basically identical to the hydrofoil unit 162, to be described. The units 72' are mounted to be adjustable in respect to their post 74' in the same manner as unit 162.

Another difference, the male adjustment of the post 74' with respect to the plate 84' has been eliminated and in lieu thereof a motor operated adjustment has been provided. Located on the side of the post 74' are a series of threads 140. The threads 140 cooperate with a threaded member 142 which is basically cylindrical in configuration and is rotatably mounted between plates 144 and 146. The plates 144 and 146 are fixedly secured to a housing 148.

The housing 148 is fixedly secured the plate 84'. Located between the plates 144 and 146 is a motor 150 which is to be driven by a source of electricity (not shown). The drive shaft 152 of the motor is connected to a gear 154. The gear 154 connects to a drive belt 156. The drive belt 156 passes over an idler gear 158 and is connected to a gear 160 which is integrally formed upon the member 142.

Activation of the reversible motor 150 the drive belt 156 causes rotation of the member 142 which operates against the threaded section 140 to either raise or lower the member 72'.

Additionally, within FIGS. 6 and 7, instead of the hydrofoil type member mounted on the outboard motor post 32', a different type of member 162 is attached to post 32'. The member 162 is basically U-shaped in configuration with the post 32' being located between the legs of the U-shaped member 162. Each of the legs of the U-shaped member 162 are fixedly connected together by rod 164. Centrally mounted upon the rod 164 is a gear 166. The gear 166 cooperates with the drive belt 168. This drive belt 168 is located within the interior of the outboard motor post 32'.

The free end of the belt 168 connects with a gear 170 which is located adjacent the outboard motor housing 26'. The gear 170 connects to a drive shaft 172 which, in turn, is connected to a motor (not shown). The motor is activated through electrical wires 174.

Upon activation of the motor and the rotation of the drive shaft 172, the belt 168 is moved which, in turn, causes rotation of the gear 166. Because the motor is reversible, movement of the belt 168 in either direction is possible. This, in turn, causes the rotation of the rod 164 which causes the member 162 to assume an inclined position. This inclining of the member 162 is to adjust the lifting force at the rear end of the boat to thereby position the boat at either a slight forward incline or at a level position.

What is claimed is:

1. In combination with a boat hull, a hydrofoil kit connectable with said hull, said hydrofoil kit comprising:

a first hydrofil unit connectable by first connecting means to starboard side of said hull;

a second hydrofil unit connectable by second connecting means to the port side of said hull, each said hydrofil unit including a hydrofoil member spaced below the bottom of said hull;

interconnecting means connecting said first hydrofoil unit and said second hydrofoil unit, said interconnecting means securely binding together said hydrofoil units to said hull; and said interconnecting means including a flexible band assembly extending across the bottom of said hull, tightening means connected with said flexible band to make said flexible band taut.

2. In combination with a boat hull, a hydrofoil kit connectable with said hull, said hydrofoil kit comprising:

a first hydrofoil unit connectable by first connecting means to starboard side of said hull;

a second hydrofoil unit connectable by second connecting means to the port side of said hull, each said hydrofoil unit including a hydrofoil member spaced below the bottom of said hull;

interconnecting means connecting said first hydrofoil unit and said second hydrofoil unit, said interconnecting means securely binding together said hydrofoil units to said hull;

an outboard motor assembly being connected to the stern of said boat hull, a third hydrofoil unit connected to said outboard motor assembly, said third hydrofoil unit including a third hydrofoil member spaced below the bottom of said hull, said outboard motor assembly including a prop adapted to be located beneath the surface of the water, said hydrofoil member located above said prop;

adjustment means mounting said outboard motor assembly to said boat hull, said adjustment means being capable of adjustably moving said outboard motor assembly in respect to said hull;

said adjustment means including a winch assembly connected to a driving belt which rotates a pair of spaced apart threaded members, said outboard motor assembly including an outboard motor housing, said threaded members being connected to appropriate threaded sections formed on the exterior of said outboard motor housing, whereby upon manual turning of said winch said threaded members rotate in a clockwise or counterclockwise direction which, in turn, either raises or lowers said outboard motor assembly with respect to said boat hull.

3. In combination with a boat hull, a hydrofil kit connectable with said hull, said hydrofoil kit comprising:

a first hydrofil unit connectable by first connecting means to starboard side of said hull;

a second hydrofoil unit connectable by second connecting means to the port side of said hull, each said hydrofoil unit including a hydrofoil member spaced below the bottom of said hull;

interconnecting means connecting said first hydrofoil unit and said second hydrofoil unit, said interconnecting means securely binding together said hydrofoil units to said hull;

an outboard motor assembly being connected to the stern of said boat hull, a third hydrofoil unit connected to said outboard motor assembly, said third hydrofoil unit including a third hydrofoil member spaced below the bottom of said hull, said outboard motor assembly including a prop adapted to be located beneath the surface of the water, said hydrofoil member located entirely above said prop;

said third hydrofoil member being movable to different angular positions with respect to said outboard motor assembly, movement means connected to said outboard motor assembly and said third hydrofoil member to move said third hydrofoil member to a selected angular position and maintain the said member in that position, whereby the stern of said boat hull being selectably raised or lowered within the water by selecting the said angular position of said third hydrofoil member;

adjustment means mounting said outboard motor assembly to said boat hull, said adjustment means being capable of adjustably moving said outboard motor assembly in respect to said hull to raise and lower said outboard motor assembly within the water, said adjustment means including means for fixedly positioning said outboard motor assembly at a selected position; and said adjustment means including a winch assembly connected to a driving belt which rotates a pair of spaced apart threaded members, said outboard motor assembly including an outboard motor housing, said threaded members being connected to appropriate threaded sections formed on the exterior of said outboard motor housing, whereby upon manual turning of said winch said threaded members rotate in a clockwise or counterclockwise direction which, in turn, either raises or lowers said outboard motor assembly with respect to said boat hull.

* * * * *